US008302440B2

(12) United States Patent
Tezuka et al.

(10) Patent No.: US 8,302,440 B2
(45) Date of Patent: Nov. 6, 2012

(54) THICKNESS CONTROL APPARATUS OF REVERSING ROLLING MILL

(75) Inventors: Tomoyuki Tezuka, Tokyo (JP); Masashi Tsugeno, Tokyo (JP)

(73) Assignee: Toshiba Mitsubishi-Electric Industrial Systems Corporation, Tokyo (JP)

( * ) Notice: Subject to any disclaimer, the term of this patent is extended or adjusted under 35 U.S.C. 154(b) by 638 days.

(21) Appl. No.: 12/595,244

(22) PCT Filed: Apr. 12, 2007

(86) PCT No.: PCT/JP2007/058041

§ 371 (c)(1),
(2), (4) Date: Nov. 5, 2009

(87) PCT Pub. No.: WO2008/129634

PCT Pub. Date: Oct. 30, 2008

(65) Prior Publication Data

US 2010/0050721 A1 Mar. 4, 2010

(51) Int. Cl.

*B21B 37/00* (2006.01)
*B21B 37/18* (2006.01)
*B21B 37/72* (2006.01)

(52) U.S. Cl. ..... 72/9.2; 72/8.1; 72/9.5; 72/10.3; 72/10.4; 72/10.7; 72/11.2; 72/11.8; 72/205; 72/229

(58) Field of Classification Search ..... 72/8.9, 72/9.2, 9.5, 10.1, 10.3, 10.4, 10.7, 11.2, 11.8, 72/205, 229; 364/472.04

See application file for complete search history.

(56) References Cited

U.S. PATENT DOCUMENTS

| | | | | | |
|---|---|---|---|---|---|
| 3,574,280 | A | * | 4/1971 | Smith, Jr. | 72/10.4 |
| 3,881,335 | A | * | 5/1975 | Cook | 72/10.4 |
| 4,125,004 | A | * | 11/1978 | Alshuk | 72/9.2 |
| 4,244,025 | A | * | 1/1981 | Alshuk | 72/229 |
| 4,760,723 | A | * | 8/1988 | Nakagawa | 72/205 |

FOREIGN PATENT DOCUMENTS

| | | | |
|---|---|---|---|
| JP | 8-243614 | A | 9/1996 |
| JP | 9-295019 | A | 11/1997 |
| JP | 2002-153906 | A | 5/2002 |
| JP | 2002-282915 | A | 10/2002 |
| JP | 2004-216396 | A | 8/2004 |
| JP | 2007-000890 | A | 1/2007 |

OTHER PUBLICATIONS

Korean Office Action, (Nov. 1, 2011).
English translation of Korean Office Action (Nov. 1, 2011.

* cited by examiner

*Primary Examiner* — David B Jones
(74) *Attorney, Agent, or Firm* — Leydig, Voit & Mayer, Ltd.

(57) ABSTRACT

A thickness control apparatus of a reversing rolling mill has an entry thickness gauge that measures the thickness of the material to be rolled, and entry material speed detector that detects the speed of the material to be rolled. Measured thickness measured by the entry thickness gauge is tracked on the basis of the speed of the material to be rolled detected by the entry material speed detector. A mill delivery thickness calculator calculates thickness on the delivery side of the reversing rolling mill on the basis of the thickness on the entry side and the roll gap detected.

16 Claims, 5 Drawing Sheets

THICKNESS CONTROL APPARATUS OF REVERSING ROLLING MILL

TECHNICAL FIELD

The present invention relates to a rolling mill that rolls a material to be rolled, which is made of metal and the like, and more particularly, to a thickness control apparatus of a reversing rolling mill that rolls a material and the like according to a pass schedule consisting of a plurality of passes.

BACKGROUND ART

In the rolling on a reversing rolling mill, a pass schedule containing various kinds of data, such as the number of passes and the thickness, tension, roll force and the like of each pass, is determined beforehand, and desired products are manufactured according to this pass schedule. In consideration of mechanical restrictions and operating conditions, usually, a pass schedule is determined on the basis of instruction data from a host computer, such as a "Level 3", by putting table settings and a mathematical formula model, in which a rolling process is expressed by mathematical formulas, to full use.

One of the important elements of this pass schedule is roll force. That is, if the roll force prediction accuracy is low, excessive roll forces are applied in actual rolling and a desired thickness is not obtained although it has been judged during a pass schedule calculation that a material is capable of being rolled, and in the worst case, it becomes impossible to continue rolling.

In general, on a reversing rolling mill, constant roll force control is often carried out particularly for head and tail portions. Constant roll force control is a rolling method that involves controlling a roll gap so that actual roll forces become equal to reference roll forces. Because at this time control based on measured values of a thickness is not carried out, the roll force prediction accuracy has a direct effect on a thickness when constant roll force control is performed.

Also, even when position control is carried out, usually, the roll opening is calculated from predicted roll force values and hence the roll force prediction accuracy remains to be important. If the thickness accuracy is low, scraps are produced from parts, causing a decrease in yield. Also in consideration of this point, improving the roll force prediction accuracy is essential.

In view of these circumstances, various studies have hitherto been carried out and various proposals have been made to improve the roll force prediction accuracy. For example, in Japanese Patent Laid-Open No. 8-243614, the learning of parameters for a roll force prediction formula is performed for each pass, thereby to improve the roll force prediction accuracy. A pass schedule is corrected on the basis of the results of the learning and predicted roll force values are recalculated, thereby to improve the thickness accuracy.

In Japanese Patent Laid-Open No. 2002-282915, it is claimed that the most important factor responsible for impeding rolling is the difference between predicted roll force values and actual roll force values and that the main factor is ascribed to the difference between nominal thicknesses of a base material and actual thicknesses and the difference between the deformation resistance set in a pass schedule and actual deformation resistance. Furthermore, it is claimed that by calculating actual deformation resistance after the finish of one pass and correcting a pass schedule, it is possible to minimize the difference between roll forces set in a pass schedule and actual roll forces.

Patent Document 1: Japanese Patent Laid-Open No. 8-243614

Patent Document 2: Japanese Patent Laid-Open No. 2002-282915

DISCLOSURE OF THE INVENTION

Problems to be Solved by the Invention

However, particularly in head and tail portions, it cannot be said that the above-described two conventional methods are adequate. That is, as described above, although the effect that the roll force prediction accuracy has on a thickness is serious, for the reasons given below good thicknesses cannot be obtained in head and tail portions from the roll force prediction by the conventional methods and this causes a decrease in yield.

That is, thickness deviations are great in head and tail portions and actual thicknesses do not always become equal to the thicknesses set in a pass schedule, or errors are not held within a certain amount. Because roll force predictions are performed on the basis of the thicknesses set in a pass schedule, a decrease in the roll force prediction accuracy is a natural consequence.

Also, although in both of the above-described methods, thicknesses after rolling are measured and used in the learning of roll force prediction formulas or in the calculation of deformation resistance, measuring the thickness of tails of rolled materials is not always possible and this case poses the problem that it is necessary to obtain thicknesses after rolling by some method.

Furthermore, in head and tail portions, in addition to great thickness deviations, unlike steady portions, rolling conditions, such as temperature, are not stable and sufficient accuracies are not always obtained even if predictions are performed using a roll force prediction formula.

Hence, the present invention has been made to solve the above-described problems and has an object to provide a thickness control apparatus of a reversing rolling mill capable of good thickness accuracy even in end portions of a rolled material.

Means for Solving the Problem

The present invention relates to a thickness control apparatus of a reversing rolling mill that rolls a material to be rolled according to a pass schedule consisting of a plurality of passes.

A thickness control apparatus of a reversing rolling mill according to one aspect of the present invention includes an entry thickness gauge that is installed on the entry side of the reversing rolling mill and measures the thickness of the material to be rolled and entry material speed detecting means that detects the speed of the material to be rolled on the entry side of the reversing rolling mill.

Mill entry thickness detecting means tracks a measured thickness value measured by the entry thickness gauge to the entry side of the reversing rolling mill on the basis of the speed of the material to be rolled on the entry side of the reversing rolling mill detected by the entry material speed detecting means and detects a thickness on the entry side of the reversing rolling mill. A position detecting device detects the roll gap of the reversing rolling mill.

Mill delivery thickness calculating means calculates a thickness on the delivery side of the reversing rolling mill on the basis of the thickness on the entry side of the reversing rolling mill detected by the mill entry thickness detecting means and the roll gap detected by the position detecting device.

Pass compensation amount calculating means calculates a pass compensation amount on the basis of the pass schedule. A roll force detecting device detects roll forces of the reversing rolling mill.

Furthermore, reference roll force calculating means calculates a reference roll force at the start of rolling a next pass on the basis of the thickness on the entry side of the reversing rolling mill detected by the mill entry thickness detecting means, the thickness on the delivery side of the reversing rolling mill calculated by the mill delivery thickness calculating means, the compensation amount calculated by the pass compensation amount calculating means, and the roll forces detected by the roll force detecting device. The reference roll force calculated by the reference roll force calculating means is set in a position control device.

The thickness control apparatus of a reversing rolling mill according to above aspect preferably includes a delivery thickness gauge that is installed on the delivery side of the reversing rolling mill and measures the thickness of the rolled material and delivery material speed detecting means that detects the speed of the rolled material on the delivery side of the reversing rolling mill.

The mill delivery thickness calculating means tracks a thickness on the delivery side of the reversing rolling mill on the basis of the speed detected by the delivery material speed detecting means to the delivery thickness gauge, compares the thickness on the delivery side of the reversing rolling mill with the thickness measured by the delivery thickness gauge, and compensates for the thickness on the delivery side of the reversing rolling mill on the basis of a difference between the two.

By above described compensation of the thickness on the delivery side, the thickness on the delivery side of the rolling mill can be calculated with increased accuracy. As a result, accuracy of the reference roll force calculation can be improved, and the thickness is further improved.

A thickness control apparatus of a reversing rolling mill according to the other aspect of the present invention includes an entry thickness gauge that is installed on the entry side of the reversing rolling mill and measures the thickness of the material to be rolled and entry material speed detecting means that detects the speed of the material to be rolled on the entry side of the reversing rolling mill.

Mill entry thickness detecting means tracks a measured thickness value measured by the entry thickness gauge to the entry side of the reversing rolling mill on the basis of the speed of the material to be rolled on the entry side of the reversing rolling mill detected by the entry material speed detecting means and detects a thickness on the entry side of the reversing rolling mill. Delivery material speed detecting means detects the speed of the rolled material on the delivery side of the reversing rolling mill.

Mill delivery thickness calculating means calculates a thickness on the delivery side of the reversing rolling mill on the basis of the thickness on the entry side of the reversing rolling mill detected by the mill entry thickness detecting means, the speed of the material to be rolled on the entry side of the reversing rolling mill detected by the entry material speed detecting means, and the speed of the rolled material on the delivery side of the reversing rolling mill detected by the delivery material speed detecting means.

Pass compensation amount calculating means calculates a pass compensation amount on the basis of the pass schedule. A roll force detecting device detects roll forces of the reversing rolling mill.

Furthermore, reference roll force calculating means calculates a reference roll force at the start of rolling a next pass on the basis of the thickness on the entry side of the reversing rolling mill detected by the mill entry thickness detecting means, the thickness on the delivery side of the reversing rolling mill calculated by the mill delivery thickness calculating means, the correction amount calculated by the pass compensation amount calculating means, and the roll forces detected by the roll force detecting device. The reference roll force calculated by the reference roll force calculating means is set in a position control device.

The thickness control apparatus of a reversing rolling mill according to each of above-described aspects preferably includes a delivery thickness gauge that is installed on the delivery side of the reversing rolling mill and measures the thickness of the rolled material.

The mill delivery thickness calculating means tracks a thickness on the delivery side of the reversing rolling mill on the basis of the speed detected by the delivery material speed detecting means to the delivery thickness gauge, compares the thickness on the delivery side of the reversing rolling mill with the thickness measured by the delivery thickness gauge, and compensates for the thickness on the delivery side of the reversing rolling mill on the basis of a difference between the two.

By above described compensation of the thickness on the delivery side, the thickness on the delivery side of the rolling mill can be calculated with increased accuracy. As a result, accuracy of the reference roll force calculation can be improved, and the thickness is further improved.

In the thickness control apparatus of a reversing rolling mill according to each of above-described aspects, preferably, the reference roll force calculating means sets a reference roll force at an upper limit value or a lower limit value of a range that is set beforehand when a calculated target value exceeds the range. This makes it possible to suppress unstable operation due to, for example, an excessive roll force.

The thickness control apparatus of a reversing rolling mill according to each of above-described aspects preferably includes roll gap calculating means that calculates a target roll gap on the basis of the roll force calculated by the reference roll force calculating means. The target roll gap calculated by the roll gap calculating means is set in the position control device. This makes it possible to deal with a case where initial setting at the start of rolling is roll gap.

In the thickness control apparatus of a reversing rolling mill according to each of above-described aspects, preferably, the entry material speed detecting means is a material speed meter provided on the entry side of the reversing rolling mill.

Advantages of the Invention

According to the present invention, in a reversing rolling mill, the reference roll force accuracy at the start of rolling or the roll gap accuracy is improved and, as a result, the thickness of end portions of a rolled material is improved. Also, this leads to the shortening of off gauge lengths in end portions of a rolled material and hence it is possible to improve yields.

BEST MODE FOR CARRYING OUT THE INVENTION

First Embodiment

Embodiments of the present invention will be described in detail below.

Figure 1:
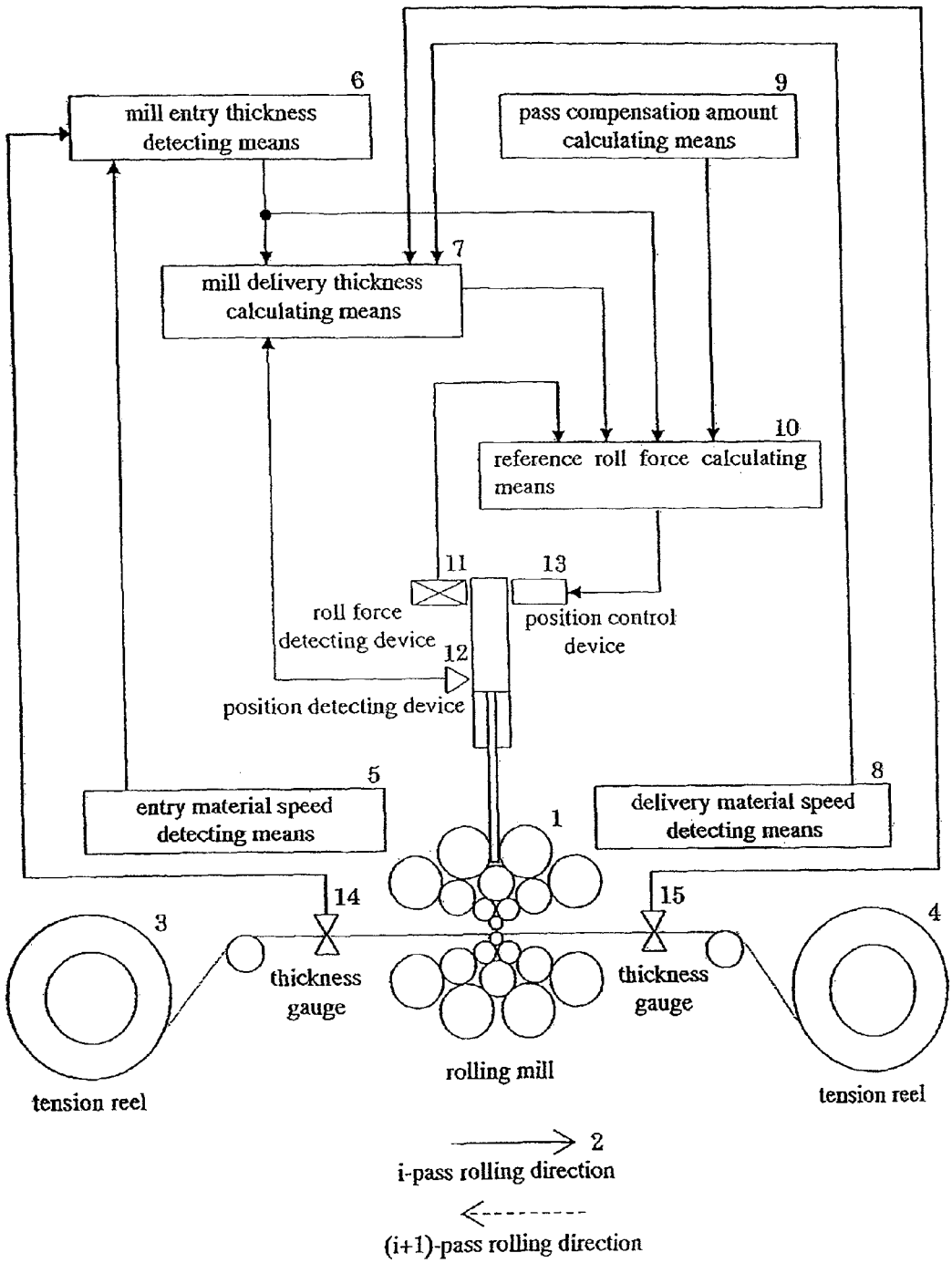
FIG. 1 is a block diagram showing the configuration of the first embodiment of the present invention along with a rolling mill to which the embodiment is to be applied.

FIG. 1 is a block diagram showing the configuration of an embodiment of the present invention along with a rolling mill to which the embodiment is to be applied. In this figure, the rolling mill 1 is a 20 high Sendzimir mill. The Sendzimir mill is known as a rolling mill suitable for the rolling of difficult-to-roll materials, such as stainless steel, in particular.

When rolling is performed in the rightward direction 2 (an arrow) as shown in the figure, a coil is unwound on a tension reel 3 on the left side, then rolled on the rolling mill 1, and wound again on a tension reel 4 on the right side. This operation of rolling once is called a pass, and by repeating this rolling a plurality of passes, the coil is rolled to a desired thickness. Usually, when stainless steel is rolled on a Sendzimir mill, the rolling is performed, with a part of the material being rolled left wound on both tension reels.

Figure 2:
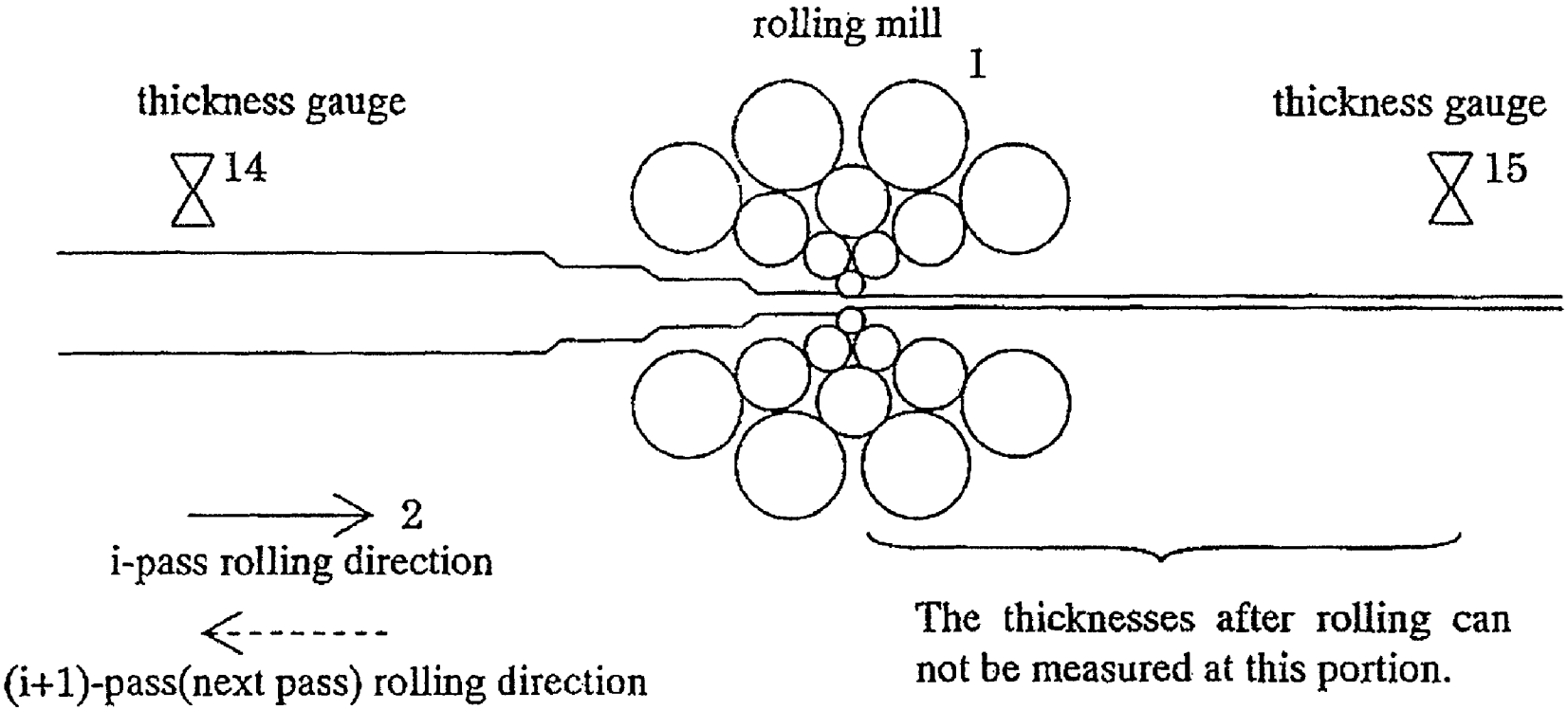
FIG. 2 shows the condition obtained after a rightward pass is completed.

FIG. 2 shows the condition obtained after a rightward pass is completed. As shown in the figure, the thickness after rolling cannot be measured at the end portion. And the next pass is started by reversing the direction from this state. Furthermore, though not shown in FIG. 1, there is also a case where a payoff reel that delivers the rolled material is provided.

A desired thickness is obtained by performing multi-pass rolling on the rolling mill 1. An outline of this operation is given. First, a function of setting calculation, which is not shown in the figure, calculates set values or target values and the like, such as the number of passes required to obtain a desired thickness, and the thickness, tension, roll force and the like of each pass, on the basis of instruction data given by a host computer, such as the thickness, width, steel grade of a base material, and the product thickness that becomes a desired thickness. Hereinafter, these set values or target values and the like, such as the number of passes required to obtain a desired thickness, and the thickness, tension, roll force and the like of each pass, are collectively called as a pass schedule. A pass schedule is determined before the start of rolling and calculated by using a mathematical formula model, in which a rolling process is expressed by mathematical formulas in addition to table settings.

In general, there are model errors in a mathematical formula model, and hence model learning is performed for each material to be rolled or for each pass, whereby the processing to raise the accuracy of the mathematical formula model is performed. Unless model learning is performed by using stable data, contrary to expectations, the worsening of the accuracy is caused by this. Therefore, usually, stable data in a steady portion (the portion other than head and tail portions) is used in model learning.

Furthermore, the function of setting calculation performs model learning and recalculates a pass schedule, thereby aiming to stabilize operation and improve product quality. A material to be rolled is rolled to a desired thickness according to a pass schedule determined like this. After the determination of the pass schedule, rolling is started.

In a steady portion, the thickness is controlled so that the thickness becomes equal to a thickness set in a pass schedule by performing automatic thickness control based on measured values of a thickness gauge, whereas constant roll force control is performed in head and tail portions. While constant roll force control is being carried out, a roll gap is controlled so that actual roll forces become equal to roll forces set in a pass schedule and control based on measured thickness values is not performed. Therefore, the thickness accuracy is greatly influenced by the roll force prediction accuracy.

Hereinafter, the description will be given on the assumption that rolling is performed in the rightward direction 2 in an i-th pass (hereinafter called an i-path) and a case where a reference roll force or a target roll gap in an (i+1)-pass, which is the next pass, is calculated is taken as an example.

The configuration and operation of the first embodiment will be described.

First, entry material speed detecting means 5 is described.

Some methods are conceivable as the entry material speed detecting means 5. The easiest method is to provide a material speed meter capable of directly measuring the speed of a material to be rolled on the entry side of the rolling mill. However, a material speed meter is expensive and maintenance thereof is no easy matter. Therefore, a material speed meter is often not installed.

Therefore, the use of a deflector roll or a sensor roll (a shape meter) installed on the entry side of the rolling mill is conceivable. Because the rotation speed of these rolls can be easily detected, it is possible to detect the roll peripheral speed, i.e., the material speed by the multiplication by the roll diameter.

As a similar technique, it is also possible to find the material speed from the rotation speed of the entry tension reel and the coil diameter. It is also possible to obtain the material speed by using a backward slip that is set beforehand and the roll peripheral speed of the rolling mill.

Next, mill entry thickness detecting means 6 stores the thickness $H^M_i$ of a material to be rolled measured by a thickness gauge 14 installed on the entry side of the rolling mill and tracks a measuring point to the rolling mill on the basis of the material speed detected by the above-described entry material speed detecting means 5. And when the measuring point has reached the entry side of the rolling mill, the mill entry thickness detecting means 6 takes out the above stored thickness $H^M_i$ as the mill entry thickness $H^D_i$. As a result of this, the mill entry thickness detecting means 6 can constantly detect the thickness on the entry side of the rolling mill.

Through the use of the mill modulus $M_i$ and the plasticity coefficient $Q_i$, which was obtained at the determination of the pass schedule and set beforehand, mill delivery thickness calculating means 7 calculates the mill delivery thickness $h^C_i$ as follows from the mill entry thickness $H^D_i$ detected by the mill entry thickness detecting means 6 and the roll gap $S_i$ detected by a position detecting device 12.

$$h_i^C = \frac{M_i}{M_i + Q_i} \times S_i + \frac{M_i}{M_i + Q_i} \times H_i^D \tag{1}$$

From this calculation, thanks to the mill delivery thickness calculating means 7 it is possible to obtain the thickness on the delivery side of the rolling mill even when the rolling point in the head portion does not reach a delivery thickness gauge 15.

Furthermore, the mill delivery thickness calculating means 7 stores the mill delivery thickness $h^C_i$ calculated by equation (1) and tracks the rolling point to the thickness gauge 15 provided on the delivery side of the rolling mill on the basis of the material speed on the delivery side of the rolling mill detected by delivery material speed detecting means 8.

However, the delivery material speed detecting means 8 may be a material speed meter installed on the delivery side of the rolling mill, as with the entry side, or the delivery material speed detecting means 8 may also detect the material speed from the roll peripheral speed of a deflector roll or a sensor roll (shape measurement device) installed on the delivery side of the rolling mill.

When the rolling point has reached the thickness gauge 15 installed on the delivery side of the rolling mill, the mill delivery thickness calculating means 7 takes out the stored thickness $h^C_i$ as a tracked thickness $h^D_i$.

At the same time, the mill delivery thickness calculating means 7 takes in the thickness $h^M_i$ measured by the thickness gauge 15 installed on the delivery side of the rolling mill, and compensates for the mill delivery thickness $h^C_i$ calculated by equation (1) as follows from a difference between the two.

That is, the compensation is performed by the following equations:

$$h_i^L[k]=h_i^C[k]+\epsilon_i[k] \tag{2}$$

$$\epsilon_i[k]=\gamma\cdot(h_i^M[k]-h_i^D[k])+(1-\gamma)\cdot\epsilon_i[k-1] \tag{3}$$

where $h^L_i$: Mill delivery thickness after compensation $h^C_i$: Mill delivery thickness before compensation $h^M_i$: Measured value of delivery thickness $h^D_i$: Mill delivery thickness before compensation, taken out by tracking in the position of the delivery thickness gauge $\epsilon_i$: Intermediate variable $\gamma$: Compensation factor k: Calculation cycle Lastly, the mill delivery thickness calculating means 7 outputs the thickness $h^L_i$ calculated by equation (2) as the mill delivery thickness.

As described above, a higher-accuracy mill delivery thickness can be obtained by correcting the mill delivery thickness on the basis of measured values measured by the thickness gauge 15 installed on the delivery side of the rolling mill.

On the other hand, a roll force prediction formula is given by the following equation, for example:

$$P_i = km_i \times \left(1-\alpha\cdot\frac{t_{fi}}{km_i}-\beta\cdot\frac{t_{bi}}{km_i}\right)\times\sqrt{R\cdot(H_i-h_i)}\times Q_{Pi}\times B \tag{4}$$

where $km_i$: Deformation resistance $t_{fi}$: Front tension stress $t_{bi}$: Back tension stress R: Workroll radius $H_i$: Entry thickness $h_i$: Delivery thickness $Q_{Pi}$: Roll force function B: Width $\alpha,\beta$: Constant This equation is applied also to an (i+1)-pass. That is, the following equation is obtained:

$$P_{i+1} = km_{i+1}\times\left(1-\alpha\cdot\frac{t_{fi+1}}{km_{i+1}}-\beta\cdot\frac{t_{bi+1}}{km_{i+1}}\right)\times\sqrt{R\cdot(H_{i+1}-h_{i+1})}\times Q_{Pi+1}\times B \tag{5}$$

For both sides, by diving equation (5) by equation (4), we obtain:

$$\frac{P_{i+1}}{P_i}=\frac{km_{i+1}\cdot\left(1-\alpha\cdot\frac{t_{fi+1}}{km_{i+1}}-\beta\cdot\frac{t_{bi+1}}{km_{i+1}}\right)\cdot Q_{Pi+1}}{km_i\cdot\left(1-\alpha\cdot\frac{t_{fi}}{km_i}-\beta\cdot\frac{t_{bi}}{km_i}\right)\cdot Q_{Pi}}\times\frac{\sqrt{H_{i+1}-h_{i+1}}}{\sqrt{H_i-h_i}} \tag{6}$$

This equation can be changed to the following equations:

$$P_{i+1}=P_{comp\,i+1}\times\frac{\sqrt{H_{i+1}-h_{i+1}}}{\sqrt{H_i-h_i}}\times P_i \tag{7}$$

$$P_{comp\,i+1}=\frac{km_{i+1}\cdot\left(1-\alpha\cdot\frac{t_{fi+1}}{km_{i+1}}-\beta\cdot\frac{t_{bi+1}}{km_{i+1}}\right)\cdot Q_{Pi+1}}{km_i\cdot\left(1-\alpha\cdot\frac{t_{fi}}{km_i}-\beta\cdot\frac{t_{bi}}{km_i}\right)\cdot Q_{Pi}} \tag{8}$$

The deformation resistance $km_i$, front tension stress $t_{fi}$, back tension stress $t_{bi}$ and roll force function $Q_{Pi}$ of each pass are obtained at the determination of a pass schedule and hence these are known data.

Pass compensation amount calculating means 9 calculates the compensation amount $P_{comp\,i+1}$ in an i-pass and an (i+1)-pass, which is calculated by equation (8), through the use of the known data.

Reference roll force calculating means 10 calculates the reference roll force $P^R_{i+1}$ at the start of rolling of an (i+1)-pass by an equation expressed by equation (7) above.

Although the compensation amount $P_{comp\,i+1}$ is calculated by the pass compensation amount calculating means 9, actual values are used for a thickness and roll force with the exception of the delivery thickness $h_{i+1}$ of an (i+1)-pass. That is, because the next pass is an (i+1)-pass, as a matter of course, it is necessary to set the delivery thickness $h^R_{i+1}$ of an (i+1)-pass set in the pass schedule as the delivery thickness $h_{i+1}$ of an (i+1)-pass.

And in view of the fact that thickness deviations are great in end portions, actual values are used in other thickness data.

The thickness $H^D_i$ detected by the mill entry thickness detecting means 6 is used as the entry thickness $H_i$ of an i-pass, the thickness $h^L_i$ calculated by the mill delivery thickness calculating means 7 is used as the delivery thickness of an i-pass, and the roll force $P^M_i$ detected by the roll force detecting device 11 is used as the roll force of an i-pass.

If values immediately before a mill stop, average values of several scans and the like are used as these actual values, it is possible to reduce the effect of noise and the like. Furthermore, because the entry thickness $H_{i+1}$ of an (i+1)-pass is equal to the delivery thickness $h_i$ of an i-pass, this entry thickness $H_{i+1}$ is used.

As is apparent from the foregoing, it is possible to reduce the difference between actual thickness values and thicknesses set in a pass schedule by making calculations using actual thickness values in end portions, and it is possible to consider unstable elements of rolling conditions in end portions by using actual roll force values.

Furthermore, through the use of upper and lower limit values set beforehand, the reference roll force calculating means 10 makes a judgment as to whether or not the calculated reference roll force $P^R_{i+1}$ is within an appropriate range.

If an upper limit value is exceeded, the reference roll force is replaced with the upper limit value. Inversely, if a lower limit value is exceeded, the reference roll force is replaced with the lower limit value. This prevents too large roll forces or too small roll forces from being set, whereby stable operation can be maintained.

Lastly, the reference roll force calculating means 10 sets the calculated reference roll force $P^R_{i+1}$ in a position control device 13. When constant roll force control is performed, the position control device 13 performs control so that actual roll forces become equal to reference roll forces or fall in a certain range.

Second Embodiment

Figure 3:
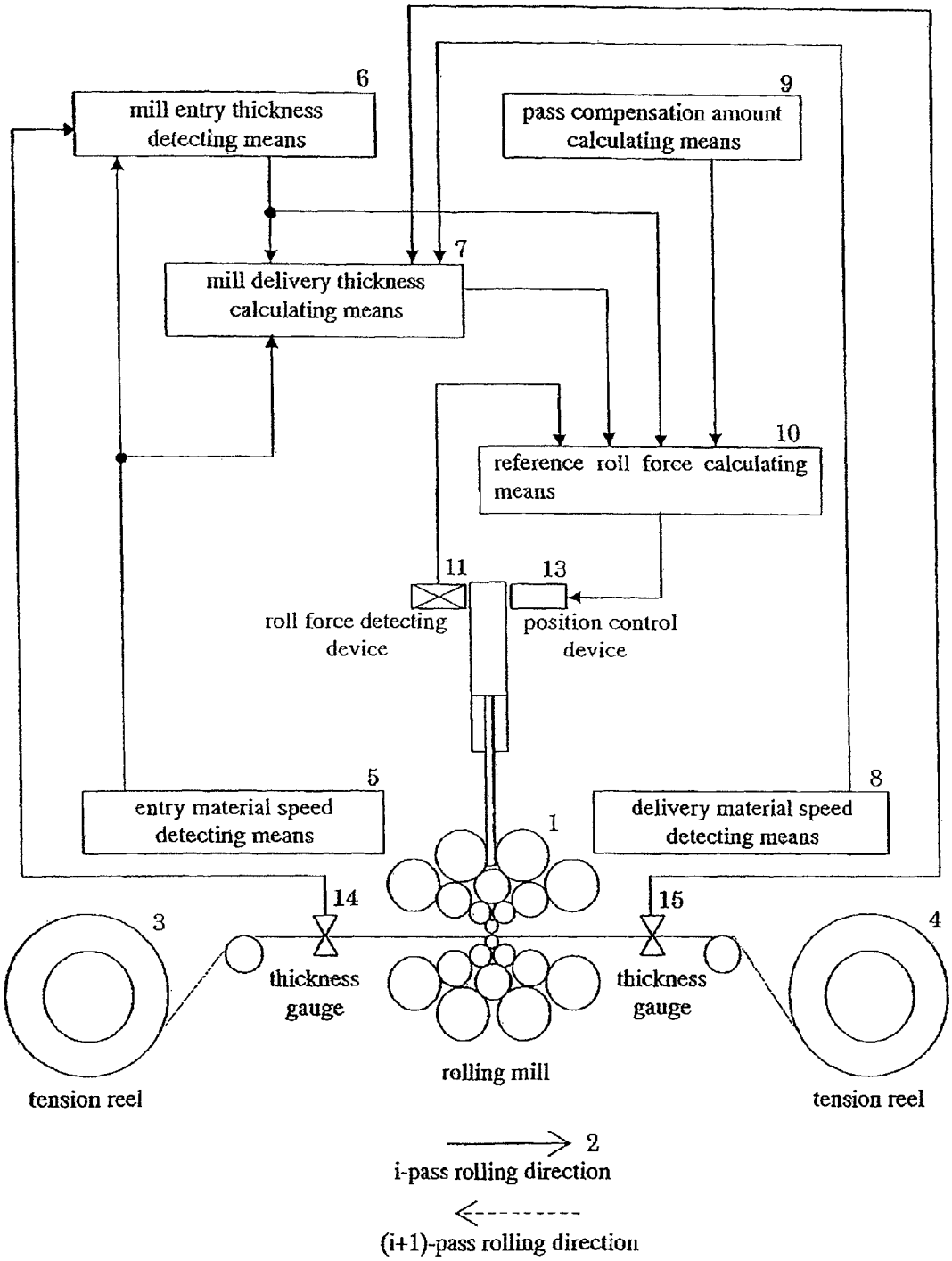
FIG. 3 is a block diagram showing the configuration of the second embodiment of the present invention along with a rolling mill to which the embodiment is to be applied.

Next, the configuration and operation of the second embodiment will be described. FIG. 3 is a block diagram showing the configuration of the embodiment of the present invention along with a rolling mill to which the embodiment is to be applied.

In this second embodiment, the position detecting device 12 in the first embodiment is not provided. Furthermore, the operation of mill delivery thickness calculating means 7 is different from the operation of the mill delivery thickness calculating means 7 of the first embodiment. Because in other respects the second embodiment is the same as the first embodiment, the description will be given of the mill delivery thickness calculating means 7 alone.

In the first embodiment the mill delivery thickness $h^C_i$ is found by the mill delivery thickness calculating means 7 by use of equation (1), whereas in the second embodiment the mill delivery thickness $h^C_i$ is found by making calculations by use of the following equation:

$$h_i^C = \frac{v_{Ei}}{v_{Xi}} \times H_i^D \tag{9}$$

where $h^C_i$: Mill delivery thickness $H^D_i$: Mill entry thickness $V_{Ei}$: Mill entry material speed $V_{xi}$: Mill delivery material speed The mill entry thickness $H^D_i$ is obtained from mill entry thickness detecting means 6, the mill entry material speed $V_{Ei}$ is obtained from entry material speed detecting means 5, and the mill delivery material speed $V_{Xi}$ is obtained from delivery material speed detecting means 8. The succeeding operation is the same as in the first embodiment.

According to this method, because the mill modulus $M_i$ that is set beforehand and the plasticity coefficient $Q_i$ are not used, it is possible to find mill delivery thicknesses with good accuracy without dependence on the accuracy of these factors.

Third Embodiment

Figure 4:
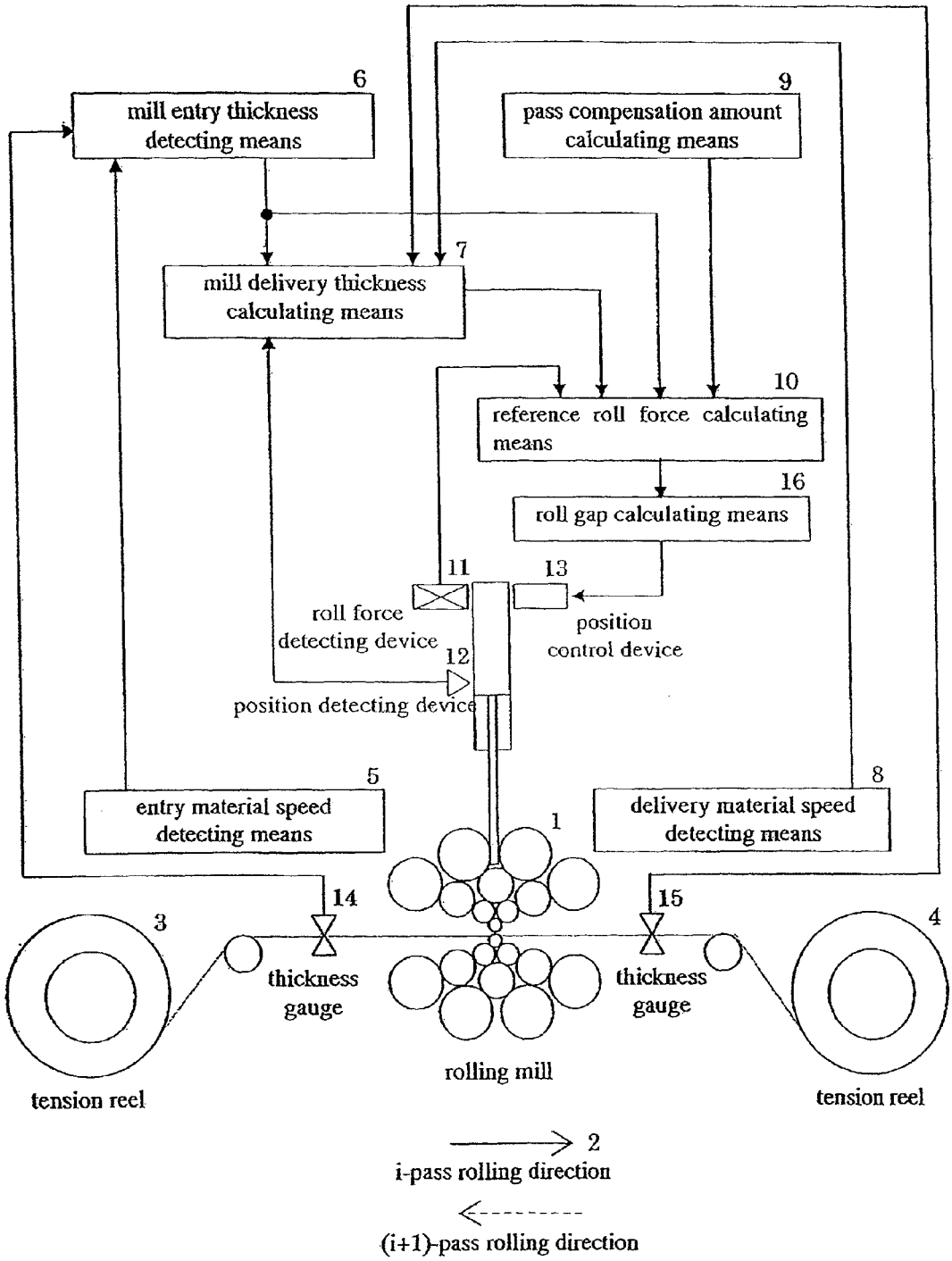
FIG. 4 is a block diagram showing the configuration of the third embodiment of the present invention along with a rolling mill to which the embodiment is to be applied.

Next, the configuration and operation of the third embodiment will be described. FIG. 4 is a block diagram showing the configuration of the third embodiment of the present invention along with a rolling mill to which the embodiment is to be applied.

Because the third embodiment is the same as the first embodiment, with the exception that roll gap calculating means 16 is added, the description will be given of the roll gap calculating means 16 alone.

In roll gap calculations, for example, the following equation, which is known as a gauge meter equation, is used:

$$h_i = S_i + \frac{P_i}{M_i} \tag{10}$$

where $h_i$: Delivery thickness $S_i$: Roll gap $P_i$: Rolling roll force $M_i$: Mill modulus By using the delivery thickness $h^R_{i+1}$ of an (i+1)-pass set in a pass schedule as the delivery thickness, the reference roll force $P^R_{i+1}$ calculated by reference roll force calculating means 10 as the rolling roll force, and a mill modulus obtained at the determination of the pass schedule as the mill modulus, it is possible to calculate from equation (10) the target roll gap $S^R_{i+1}$ that makes the delivery thickness equal to a desired value.

In the same manner as in the first embodiment, the roll gap calculating means 16 sets the calculated target roll gap $S^R_{i+1}$ in a position control device 13. The position control device 13 controls so that the roll gap is the target roll gap. As a result of this, the third embodiment becomes able to deal with a case where the setting mode at the start of rolling is roll gap, and not roll force.

Fourth Embodiment

Figure 5:
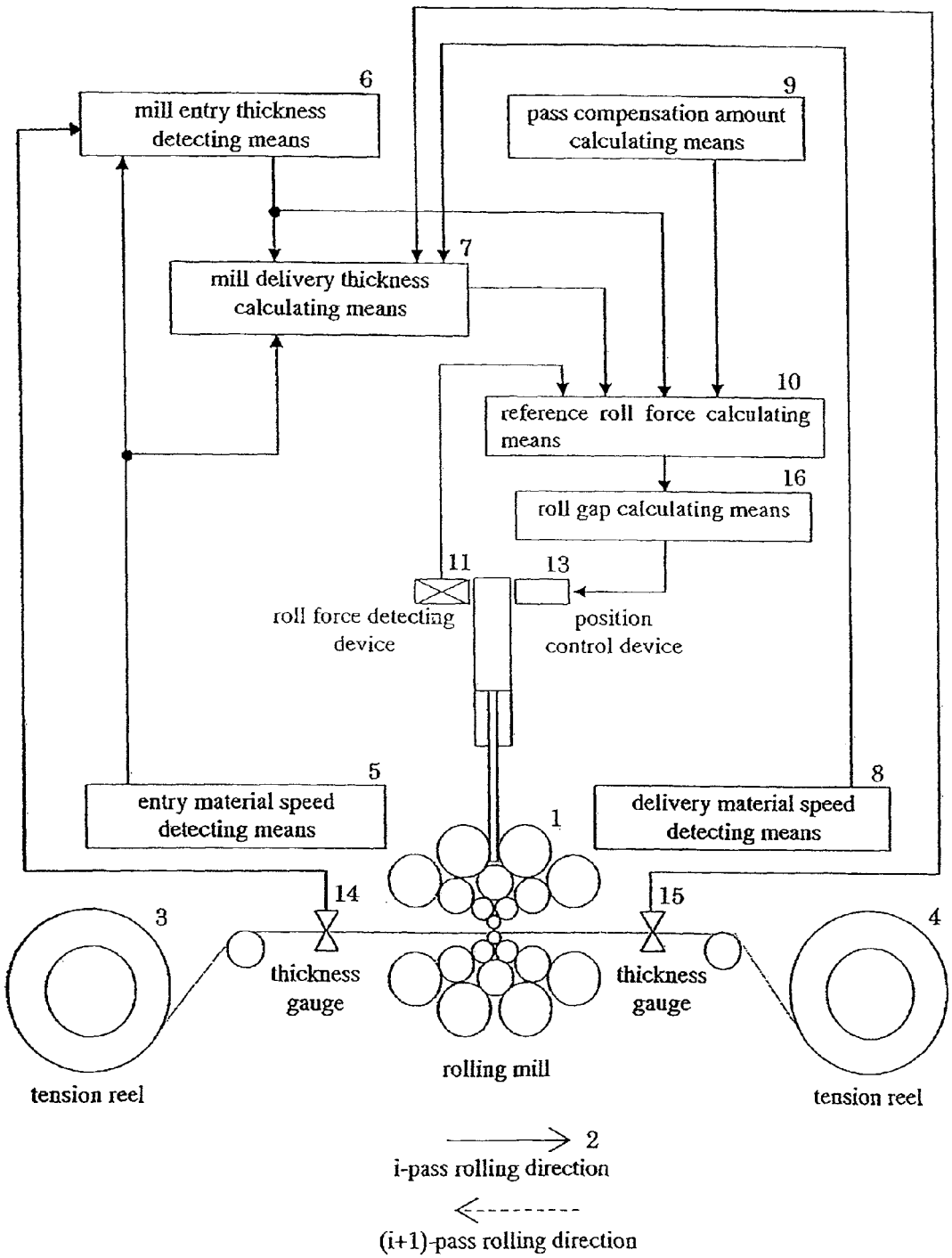
FIG. 5 is a block diagram showing the configuration of the fourth embodiment of the present invention along with a rolling mill to which the embodiment is to be applied.

Next, the configuration and operation of the fourth embodiment will be described. FIG. 5 is a block diagram showing the configuration of the embodiment of the present invention along with a rolling mill to which the embodiment is to be applied.

The fourth embodiment is the same as the second embodiment, with the exception that roll gap calculating means 16 is added.

The roll gap calculating means 16 added in this embodiment, which is the same as described in the operation of the third embodiment, calculates a target roll gap by using the above-described equation (10).

Incidentally, in each of the above-described embodiments, the description was given using roll force. However, this is not restrictive. Pressure, which is equivalent to roll force, may be detected or used for settings.

As a matter of fact, in the Sendzimir mill, pressure is detected and pressure is set.

Although the above descriptions were given of the case of the Sendzimir mill, the present invention is applicable to all types of reversing rolling mills, such as 4 high rolling mills, 6 high rolling mills and cluster mill.

The invention claimed is:

1. A thickness control apparatus of a reversing rolling mill that rolls a material according to a pass schedule consisting of a plurality of passes, the thickness control apparatus comprising:

an entry thickness gauge that is installed on an entry side of the reversing rolling mill and measures the thickness of the material to be rolled, entry material speed detecting means for detecting speed of the material to be rolled on the entry side of the reversing rolling mill, mill entry thickness detecting means for tracking thickness measured by the entry thickness gauge based on the speed of the material to be rolled detected by the entry material speed detecting means and for detecting thickness on the entry side of the reversing rolling mill, a position detecting device that detects a roll gap of the reversing rolling mill, mill delivery thickness calculating means for calculating thickness on a delivery side of the reversing rolling mill based on the thickness detected by the mill entry thickness detecting means and the roll gap detected by the position detecting device, pass compensation amount calculating means for calculating a pass compensation amount based on the pass schedule, a roll force detecting device that detects roll forces of the reversing rolling mill, and reference roll force calculating means for calculating a reference roll force at the start of a next pass, based on (i) the thickness detected by the mill entry thickness detecting means, (ii) the thickness on the delivery side of the reversing rolling mill calculated by the mill delivery thickness calculating means, (iii) the compensation amount calculated by the pass compensation amount calculating means, and (iv) the roll forces detected by the roll force detecting device, wherein the reference roll force calculated by the reference roll force calculating means is set in a position control device.

2. The thickness control apparatus of a reversing rolling mill according to claim 1, wherein the thickness control apparatus further comprises:

a delivery thickness gauge that is installed on the delivery side of the reversing rolling mill and measures thickness of the material rolled, and delivery material speed detecting means that detects speed of the material rolled on the delivery side of the reversing rolling mill, wherein the mill delivery thickness calculating means tracks the thickness on the delivery side of the reversing rolling mill based on the speed detected by the delivery material speed detecting means and the thickness measured by the delivery thickness gauge, compares the thickness on the delivery side of the reversing rolling mill to the thickness measured by the delivery thickness gauge, and compensates for the thickness on the delivery side of the reversing rolling mill based on difference between the two thicknesses.

3. A thickness control apparatus of a reversing rolling mill that rolls a material according to a pass schedule consisting of a plurality of passes, the thickness control apparatus comprising:

an entry thickness gauge that is installed on an entry side of the reversing rolling mill and measures the thickness of the material to be rolled, entry material speed detecting means for detecting the speed of the material to be rolled on the entry side of the reversing rolling mill, mill entry thickness detecting means for tracking a thickness measured by the entry thickness gauge at the entry side of the reversing rolling mill based on the speed of the material to be rolled detected by the entry material speed detecting means and for detecting thickness on the entry side of the reversing rolling mill, delivery material speed detecting means for detecting the speed of the material rolled on a delivery side of the reversing rolling mill, mill delivery thickness calculating means for calculating thickness on the delivery side of the reversing rolling mill based on the thickness on the entry side of the reversing rolling mill detected by the mill entry thickness detecting means, the speed of the material to be rolled detected by the entry material speed detecting means, and the speed of the material rolled on the delivery side of the reversing rolling mill detected by the delivery material speed detecting means, pass compensation amount calculating means for calculating a pass compensation amount based on the pass schedule, a roll force detecting device that detects roll forces of the reversing rolling mill, and reference roll force calculating means for calculating a reference roll force at the start of a next pass based on (i) the thickness on the entry side of the reversing rolling mill detected by the mill entry thickness detecting means, (ii) the thickness on the delivery side of the reversing rolling mill calculated by the mill delivery thickness calculating means, (iii) the correction amount calculated by the pass compensation amount calculating means, and (iv) the roll forces detected by the roll force detecting device, wherein the reference roll force calculated by the reference roll force calculating means is set in a position control device.

4. The thickness control apparatus of a reversing rolling mill according to claim 3, further comprising:

a delivery thickness gauge that is installed on the delivery side of the reversing rolling mill and measures the thickness of the material rolled, wherein the mill delivery thickness calculating means tracks thickness on the delivery side of the reversing rolling mill based on the speed detected by the delivery material speed detecting means and the thickness measured by the delivery thickness gauge, compares the thickness on the delivery side of the reversing rolling mill with the thickness measured by the delivery thickness gauge, and compensates for the thickness on the delivery side of the reversing rolling mill based on difference between the two thicknesses.

5. The thickness control apparatus of a reversing rolling mill according to claim 1, wherein the reference roll force calculating means sets a reference roll force at an upper limit value or a lower limit value of a range that is set beforehand when a calculated target value exceeds the range.

6. The thickness control apparatus of a reversing rolling mill according to claim 1, wherein the thickness control apparatus further comprises roll gap calculating means for calculating a target roll gap based on the roll force calculated by the reference roll force calculating means, and sets a target roll gap calculated by the roll gap calculating means in the position control device.

7. The thickness control apparatus of a reversing rolling mill according to claim 1, wherein the entry material speed detecting means is a material speed meter located on the entry side of the reversing rolling mill.

8. The thickness control apparatus of a reversing rolling mill according to claim 1, wherein the entry material speed detecting means detects peripheral speed of a deflector roll or a sensor roll installed on the entry side of the reversing rolling mill, and uses the peripheral speed as the material speed on the entry side.

9. The thickness control apparatus of a reversing rolling mill according to claim 1, wherein the delivery material speed detecting means is a material speed meter installed on the delivery side of the reversing rolling mill.

10. The thickness control apparatus of a reversing rolling mill according to claim 1, wherein the delivery material speed detecting means detects peripheral speed of a deflector roll or a sensor roll installed on the delivery side of the reversing rolling mill, and uses the peripheral speed as the material speed on the delivery side.

11. The thickness control apparatus of a reversing rolling mill according to claim 3, wherein the reference roll force calculating means sets a reference roll force at an upper limit value or a lower limit value of a range that is set beforehand when a calculated target value exceeds the range.

12. The thickness control apparatus of a reversing rolling mill according to claim 3, wherein the thickness control apparatus further comprises roll gap calculating means for calculating a target roll gap based on the roll force calculated by the reference roll force calculating means, and sets a target roll gap calculated by the roll gap calculating means in the position control device.

13. The thickness control apparatus of a reversing rolling mill according to claim 3, wherein the entry material speed detecting means is a material speed meter located on the entry side of the reversing rolling mill.

14. The thickness control apparatus of a reversing rolling mill according to claim 3, wherein the entry material speed detecting means is detecting means that detects peripheral speed of a deflector roll or a sensor roll installed on the entry side of the reversing rolling mill, and uses the peripheral speed as the material speed on the entry side.

15. The thickness control apparatus of a reversing rolling mill according to claim 3, wherein the delivery material speed detecting means is a material speed meter installed on the delivery side of the reversing rolling mill.

16. The thickness control apparatus of a reversing rolling mill according to claim 3, wherein the delivery material speed detecting means detects peripheral speed of a deflector roll or a sensor roll installed on the delivery side of the reversing rolling mill, and uses the peripheral speed as the material speed on the delivery side.

* * * * *